United States Patent [19]

Johnson et al.

[11] Patent Number: 5,000,356

[45] Date of Patent: Mar. 19, 1991

[54] SWIVEL-UP TYPE DISPENSING PACKAGE

[75] Inventors: Robert C. Johnson, Okeana, Ohio; Calvin S. Cook, Erie, Pa.; Daniel R. Long, Cincinnati, Ohio

[73] Assignee: The Procter & Gamble Company, Cincinnati, Ohio

[21] Appl. No.: 256,817

[22] Filed: Oct. 11, 1988

Related U.S. Application Data

[63] Continuation-in-part of Ser. No. 108,840, Oct. 15, 1987, abandoned.

[51] Int. Cl.[5] ..... B67D 5/42

[52] U.S. Cl. ..... 222/391; 222/340; 401/174

[58] Field of Search ..... 222/390, 391, 386, 326, 222/340, 336, 516, 518, 525, 522; 401/174, 175, 172, 68, 75

[56] References Cited

U.S. PATENT DOCUMENTS

| | | | |
|---|---|---|---|
| 1,663,338 | 3/1928 | Gagne | 222/390 |
| 1,803,524 | 5/1931 | Davis | 222/390 |
| 2,233,587 | 3/1941 | Crewe | 74/169 |
| 2,276,722 | 3/1942 | Hillman et al. | 401/175 |
| 2,923,442 | 2/1960 | Maras | 222/327 |
| 2,998,167 | 8/1961 | Boehm | 222/320 |
| 3,756,730 | 9/1973 | Spatz | 401/174 |
| 4,009,804 | 3/1977 | Costa et al. | 222/391 |
| 4,019,654 | 4/1977 | Van Manen | 222/1 |
| 4,126,251 | 11/1978 | Subwick | 222/326 |
| 4,221,490 | 9/1980 | Malm | 401/75 |
| 4,264,021 | 4/1981 | Davis, Jr. | 222/391 |
| 4,356,938 | 11/1982 | Kayser | 222/391 |
| 4,456,450 | 6/1984 | Heling | 425/376 R |
| 4,461,407 | 7/1984 | Finnegan | 222/391 |
| 4,595,124 | 6/1986 | Duval et al. | 222/39 |
| 4,624,594 | 11/1986 | Sasaki et al. | 401/176 |
| 4,681,524 | 7/1987 | Ikeda et al. | 425/376 R |
| 4,702,398 | 10/1987 | Seager | 222/386 |
| 4,778,300 | 10/1988 | French et al. | 401/55 |
| 4,923,096 | 5/1990 | Ennis | 222/391 |

*Primary Examiner*—Robert P. Olszewski
*Assistant Examiner*—Kenneth Noland
*Attorney, Agent, or Firm*—R. C. Witte; T. H. O'Flaherty; J. V. Gorman

[57] ABSTRACT

A dispensing package which automatically relieves residual pressure on a cream product and dispenses this product in incremental doses is disclosed. The package uses a feed screw to drive an elevator which impels the cream product in a unidirectional manner. The drive of the feed screw is superimposed with reciprocatory motion caused by internal cams which retract the elevator. By intermittently retracting the elevator a suitable distance, discrete amounts of the product are dispensed for each cycle and the residual pressure on the product is relieved, preventing it from weeping onto the applicating surface of the dispenser. The dispensing package is well suited to contain and dispense cream deodorants and antiperspirants.

27 Claims, 8 Drawing Sheets

SWIVEL-UP TYPE DISPENSING PACKAGE

This is a continuation-in-part of application Ser. No. 07/108,840, filed on Oct. 15, 1987, now abandoned.

FIELD OF THE INVENTION

This invention relates to swivel-up type dispensing packages and, more particularly, to swivel-up type packages used to apply cream type deodorants or antiperspirants to the underarm.

BACKGROUND OF THE INVENTION

Swivel-up dispensing packages have been used to dispense cosmetic cream products to the axillae of the user. Typically, the product is moved to the outer end by manually turning a hand wheel, which drives a feed screw and, in turn, an elevator. Moving the elevator into the product pressurizes it, causing the product to be extruded through the orifice onto the applicating surface.

An undesirable side effect of this type of dispensing package which occurs when cream products are used, is that after the product has been dispensed, residual pressure within the product in the dispenser causes the product to weep onto the applicating surface for a period of time after the user has ceased dispensing. Depending upon the material properties of the cream product contained in the dispensing package, separation may occur and individual components of the cream product could spread onto the applicating surface. Either occurrence results in a soiled and undesirable appearance of the applicating surface. Furthermore, after the product, or its components, has weeped onto the applicating surface, the product, or its components, may spread to the container body and soil the hands of the user.

One approach to relieving the residual pressure on the product is to use a spring which urges the elevator away from the product. For example, in U.S. Pat. No. 4,356,938 issued to Kayser on Nov. 2, 1982, and U.S. Pat. No. 4,461,407, issued to Finnegan on July 24, 1984 show caulking guns where a spring is used to push the ratchet bar away from the dispensed product. In U.S. Pat. No. 3,756,730 issued to Spatz on Sept. 4, 1973, this concept is applied to a dispenser having a feed screw, where a spring retracts the follower by reversing the rotation of the o feed screw. One problem inherent with this approach is the unpredictability of the amount of retraction which will occur. Variations in the amount of product dispensed, system friction, extension of the spring, etc. will cause the variations in the amount of residual pressure remaining on the product. This dispensing package provides no assurance as to how much the driven member will be retracted, or whether the amount of retraction which does occur will be enough, or too much, for a given cream product.

Furthermore, dispensers presently used normally extrude cosmetic cream products at a uniform rate as the consumer turns the hand wheel to advance the elevator. When the product is dispensed at a uniform rate, the user may not be able to visually judge the proper amount of deodorant or antiperspirant which should be applied to each underarm, much less dispense this amount on an ephemeral basis with any degree of precision. Applying too much deodorant results in product waste and staining of clothes, while applying too little deodorant prevents efficacious results from being obtained. Furthermore, when too much product is used at one time, excess product will remain on the applicating surface creating a soiled and messy appearance

BRIEF SUMMARY OF THE INVENTION

It is an object of the invention to obviate the aforementioned problems related to weeping of the product contained by the dispensing package, or components of this product, onto the applicating surface and the problems related to improper dosing of the product upon application.

It is also an object of this invention to provide a dispensing package which is easy to use while applying generally consistent amounts of a cream deodorant product on a ephemeral basis.

In accordance with one aspect of the present invention, there is provided a dispensing package for cream products. The dispensing package comprises a container body which has a uniform cross section interior chamber to hold the product and a lengthwise central axis, an elevator congruent to and which axially moves within the interior chamber, and an axially rotatable means to cause the elevator to advance forward while axially reciprocating the elevator one cycle for each increment of forward movement.

BRIEF DESCRIPTION OF THE DRAWINGS

While the specification concludes with claims particularly pointing out and distinctly claiming the present invention, it is believed that the same will be better understood from the following description taken in conjunction with the accompanying drawings wherein like parts will be given the same reference number in the different figures and similar or analogous parts are designated by applying one or more prime symbols to the number:

DETAILED DESCRIPTION OF THE INVENTION

Figure 1:
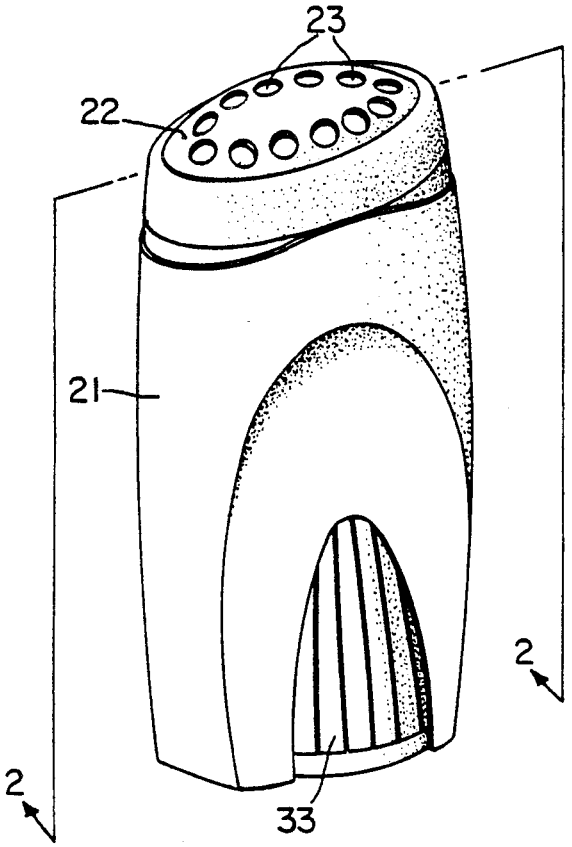
FIG. 1 is a perspective view of one embodiment of the dispensing package of the present invention employing a hand wheel to effect dispensing.

The swivel-up dispensing package, as illustrated in FIG. 1, has a body 21 preferably made of polypropylene or other suitable material. The size should allow the dispenser to be conveniently held by the user, yet large enough to accommodate the internal components discussed below and the desired charge of the cream product to be dispensed. The body must also be sturdy enough to provide a frame to hold the components discussed below in the described relationship. A wall thickness of approximately 1.4 to 1.7 mm (0.055 to 0.065 inches) has been found adequate, without requiring excess material. All of the plastic parts discussed below are best made using standard injection molding techniques and a homopolymer polypropylene.

Figure 2:
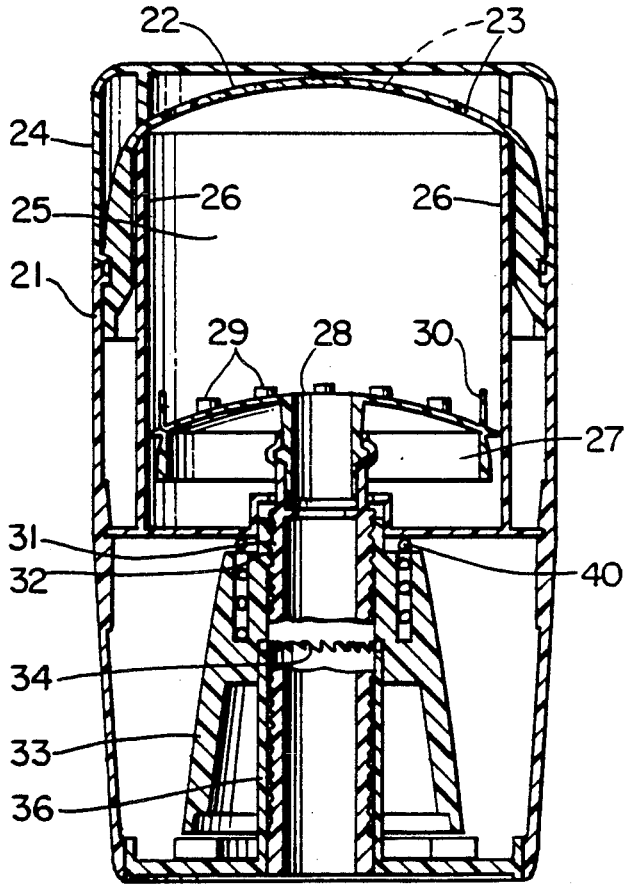
FIG. 2 is a vertical sectional view taken along line 2—2 of FIG. 1 after application of a closure to the dispensing package.

When the body 21 is held in the normal or upright position, the axis of the body 21 is vertical as illustrated by FIGS. 1 and 2. At the top of the body 21 is an applicating surface 22 which forms the outer end of the container body and serves two functions. First, if the cream product is dispensed by contact with the surface to which it is applied, the applicating surface 22 provides for a uniform distribution of the product without an excessive or wasteful amount being applied. Also, the surface protects the product from external contamination when the dispenser is not in use.

The polypropylene applicating surface 22 may be generally flat, arcuate or any shape judged advantageous for applying the product in the desired manner. The arcuate shape shown in FIGS. 1 and 5 has a compound curvature, with a radius of approximately 21 mm (0.84 inches) in the short direction and a radius of approximately 5.75 cm (2.265 inches) in the longer direction. This curvature has been selected because it conforms well to the axilla area. The applicating surface 22 has one or more orifices 23 positioned therein which allow the product to be conveyed from an interior product chamber to the desired surface. The size, number, and distribution of the orifices 23 must be considered along with the shape of the applicating surface 22 and material properties of the cream product being dispensed to ensure proper application will result. An applicating surface 22 having four to twelve orifices 23 with a diameter of about 4.3 mm to about 7.4 mm (0.17 to 0.29 inches) has been found adequate. The orifices 23 need not be round, as shown, but may be of any shape which provides for uniform application and distribution of the cream product. An adhesive seal may be placed over the orifices 23 to prevent product from being jarred out of the dispenser during shipment, and then removed prior to the first use of the dispenser.

When the dispenser is not used for an extended period of time, a cap 24 may be placed over the applicating surface to prevent dust and other contaminates from settling thereon. The cap 24 may be engaged by a full or partial snap bead circumferentially disposed about the tubular body, a friction fit or other conventional means. The cap 24 and the adhesive seal also o provides a means to prevent loss of the cream product or its components through evaporation, weeping, etc.

Below the applicating surface 22, the product is held in an interior chamber 25 as illustrated in FIG. 2. The sides 26 of the chamber 25 may be formed by the interior surface of the container body 21, eliminating the need for additional materials, or can be a separate cavity within the body as shown in FIG. 2. The chamber 25 is bounded on the top by the wall forming applicating surface 22. The bottom of the chamber 25 is defined by the position of an elevator 27 as the elevator moves towards the applicating surface 22. The volume of the interior chamber 25 is the product of its cross sectional area and the effective distance between the elevator 27 and the applicating surface 22. This volume should be sufficient to accommodate the total amount of product to be contained when the elevator 27 is in its initial or lowermost position. A cross-sectional area of approximately 11 square centimeters (1.7 square inches) and an axial length of 43 mm (1.69 inches) will accommodate 42.5 grams (1.5 ounces) of a typical cosmetic cream product. It is important to prevent leakage of the product from the interior chamber 25, prior to the first use of the dispensing package and between subsequent usages. Therefore, seals should be provided at the junctures between the interior chamber 25 and the wall forming the applicating surface 22 and the interior chamber 25 and the elevator 27. Alternatively, the interior chamber side wall 26 and the wall forming the applicating surface 22 can be molded as a single piece, eliminating the need for a seal at this juncture. If any other seams or leakage paths are present as a result of the manufacturing process, seals should also be provided at these locations.

The elevator 27 is slidable within and tightly fitted to the sides of interior chamber 25, having a cross section that is generally perpendicular to and congruent with chamber 25. It is necessary that the fit of the elevator 27 to the interior chamber 25 be tight enough to accommodate the sealing means discussed above, but not so tight as to require excessive force to overcome the friction between the elevator 27 and interior chamber sides 26, or difficulty will be encountered when trying to move the elevator 27 towards or away from the applicating surface 22. To accommodate the preferred drive means discussed below, it is necessary that the elevator 27 not rotate with respect to the container body 21. This objective can be accomplished if the cross sections of the elevator 27 and interior chamber 25 are noncircular. The upper surface 28 of the elevator 27 is shaped to conform to the wall forming the underside of the applicating surface 22 so that virtually all of the product is dispensed when the elevator 22 is advanced to the top of chamber.

Although not shown on the drawings, either grooves or ribs may be placed near the lower elevation of sides, adjacent to elevator 27 to facilitate package filling. The grooves provide a vent channel for air displaced by filling chamber 25 with the product. Alternatively, the ribs radially deform elevator 27 allowing air to be vented during product fill. After filling is completed, the elevator 27 may be moved upwards to an elevation above the grooves or ribs and restore the seal with the sides 26 of chamber 25.

As shown in FIG. 2, affixed to the top 28 of the elevator 27 are vertical nubs 29 and deformable fins 30. These fins 30 and nubs 29 serve to alert the user when the product is nearly depleted. As the elevator 27 approaches the wall which forms the underside of the applicating surface 22, the flexible fin 30 encounters the wall in a position adjacent to an orifice 23. As the elevator 27 is further advanced, the fin 30 preferentially deflects towards an orifice 23 and begins to block the orifice 23 opening. After the side of the fin 30 has laterally crossed the orifice 23 a sufficient distance, it will become visible from the exterior of the package when one looks into the orifice 23, indicating to the user the product is nearly depleted. When the elevator 27 is fully advanced to the position where it is restrained against the outer wall which closes the interior chamber 25, the vertical nubs 29, being in alignment with orifices 23, will protrude therethrough, indicating to user that no cream product remains in the dispensing package.

The means to drive the elevator 27 from its initial position towards the applicating surface 22, comprises a feed screw 31, perpendicularly affixed to the underside of the elevator 27. The elevator 27 and feed screw 31 may be molded from one piece of material, preferably polypropylene, or attached by known means such as a collar which prevent separation or rotation of the feed screw 31 relative to the elevator 27. The feed screw 31 is also made of polypropylene and provides an axial advance ranging from about 1.0 to about 5.1 mm (0.040 to 0.20 inches) per rotation depending upon the number of cams 34 and dosage desired. The length of the feed screw 31 must correspond to at least the axial dimension of the interior product chamber 25. The diameter of the feed screw 31, is not critical, and can range from about 3.2 to about 17.3 mm (0.125 to 0.680 inches). If the dispensing package is filled by injecting the product through a hollow feed screw, a diameter near the upper end of the range should be selected, and a plug should be inserted in the bottom of the hollow feed screw to prevent subsequent loss of the product.

Since the elevator 27 is nonrotatable with respect to the container body 21 and perpendicular to the central axis, the feed screw 31 is similarly nonrotatable with respect to the container body 21 and aligned with the central axis. The feed screw 31 is advanced in the forward axial direction by the relative rotation of an internally threaded nut 32 which is threaded onto the feed screw 31 and aligned with the feed screw 31 along the axis of the body 21. In the preferred embodiment illustrated by FIG. 2, the nut 32 is molded into or otherwise made a part of a rotatable injection molded polypropylene hand wheel 33, which is large enough to extend outside of the container body 21 and be easily grasped by the user. As the user rotates the hand wheel 33 about an axis coincident with the feed screw 31, the threaded engagement of nut or hub 32 associated with the hand wheel 33 causes axial advance of the feed screw 31 and elevator 27, thus extruding the cream product through the orifice 23 in the applicating surface 22. Continued rotation of the hand wheel 33 will advance the feed screw 31 and elevator 27 until the elevator 27 is restrained by the interior of the applicating surface 22. The hand wheel 33 surface may be textured with vertical grooves or ribs which improve the user's grasp.

As known to those skilled in the art, advancing an elevator 27 which extends throughout the entire cross section of the product chamber 25 while only relieving product through orifices 23 which have a lesser cross sectional area will result in residual pressure of a thick cream product which has a nonzero yield pressure. The yield pressure is defined as the pressure at which simple deformation of the structural matrix ceases and the product undergoes permanent loss of its structural integrity. The yield pressure can be estimated by expelling the product through a representative applicating surface 22 with an elevator and recording the pressure which remains on the elevator after its motion is stopped, or the yield pressure can be measured by a viscometer as the maximum point on a shear stress versus shear rate curve. This residual pressure will cause the cream product, or its components, to weep onto the applicating surface 22, resulting in an undesirable appearance and product waste. A typical cosmetic cream product has a yield pressure ranging from 4 to 20 grams per square centimeter.

To prevent this effect, the dispensing package axially retracts the elevator 27, in a reciprocating cycle after each predetermined increment of forward axial movement. This is accomplished by superimposing alternating axial reciprocative displacements onto the unidirectional axial advance of the feed screw 31 due to its threaded engagement with nut 32. The axial advance of the feed screw 31 has been described in detail above and will not be repeated here. The axially reciprocating displacement of the elevator 27, is accomplished by a cam 34 and follower 35. Either the cam 34, or follower 35, can be associated with the rotary input provided by the drive element, and either the cam 34, or follower 35, can be attached to the feed screw 31, hand wheel 33 or elevator 27.

Figure 3:
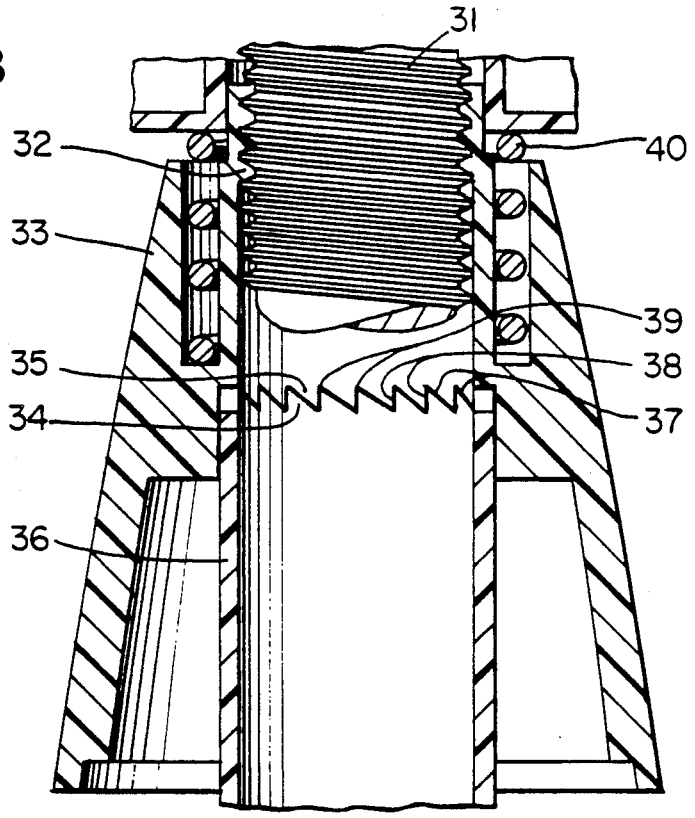
FIG. 3 is an enlarged fragmentary vertical cross-sectional view showing the mechanism to achieve axial reciprocation of the elevator, immediately following retraction.

The embodiment shown in FIG. 3 includes uniformly sized saw tooth shaped cams 34 rigidly disposed about the end of a polypropylene vertical post 36 which is affixed in a stationary manner to the container body 21. Cams 34 having an axial dimension ranging from about 0.25 to about 1.40 mm (0.010 to 0.055 inches) and a forward face 37 that forms an angle between about 20° and about 50° with the horizontal plane have been found suitable for the cosmetic cream product discussed above. The number of cams 34 on the vertical post 36 will vary with the diameter of the post 36 and the angle through which the feed screw 31 is driven in each cycle. A 20.7 mm (0.815 inch) diameter post having 26 cams is suitable. Cams having a V-shape or other profile may also be used, but the saw tooth profile having a ramped forward face 37 and a secondary vertical face 38 which is parallel to the axis of the feed screw 31 has been found to yield the most favorable results. The forward face 37 may be biased coincident with the lead angle of the feed screw 31 towards the center of the vertical post 36 such that planar contact is maintained between the cam faces 37 and follower 35 to reduce wear. Preferentially, the shape of the follower 35 is also sawtooth shaped or V-shaped to correspond with the profile of the cams 34.

The vertical post 36, which holds the cams 34, must be stationary relative to the container body 21. A feasible manner to hold the post 36 and cams 34 stationary is to mold the post 36 and base of the container body 21 as a unitary piece with the base and post being mutually perpendicular. The base can then be snapped into position at the bottom of the container body 21, and held in place with a snap lock, an annular bead or other known means. When the base is in position at the bottom of the container body 21, the post 36 will be in alignment with the axis of the dispensing package. The cams 34 may be affixed directly to the base of the container body 21, eliminating post 36, if the geometry of the package, particularly hand wheel 33, is adjusted to accommodate this arrangement. The thickness of the base should generally correspond with the thickness of the walls of the container body 21, as discussed above.

Figure 4:
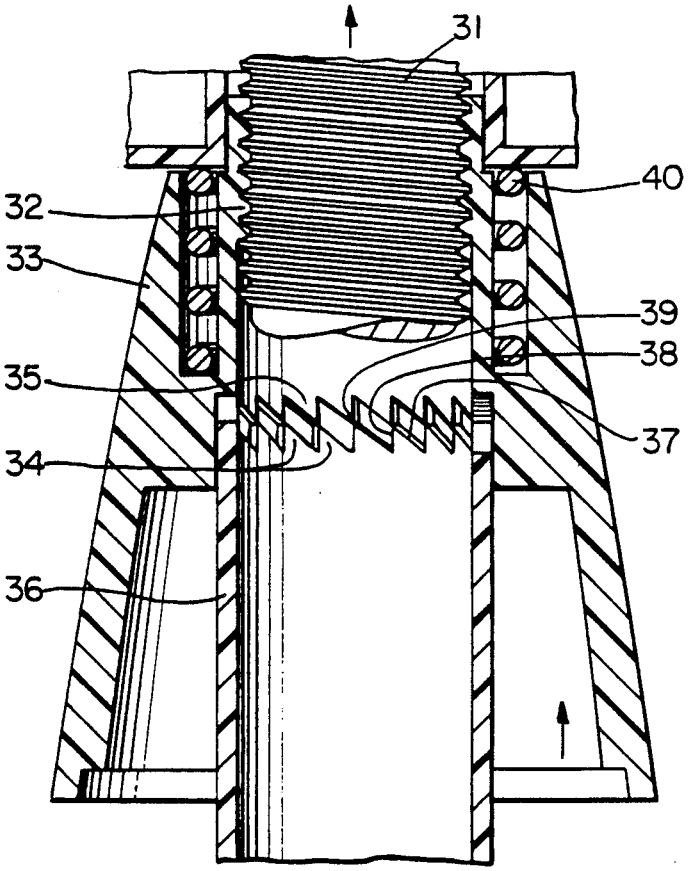
FIG. 4 is an enlarged fragmentary vertical cross-sectional view similar to FIG. 3, but showing the mechanism immediately prior to retracting.

To ride on the stationary cams 34 of the vertical post 36, identical coacting saw tooth shapes are rigidly disposed on the hand wheel 33 in the nonengaging direction. As the hand wheel 33 rides the cam 34 profile, it will float in the axial direction, imparting reciprocation to the follower. The nonengaging direction is defined as that which has the hand of the ramp angle of the forward cam faces 37 opposite to the hand of the lead angle of the thread of feed screw 31. The cams 34 may be placed below the nut 32 which engages the feed screw 31 as shown, or above the nut 32, but cannot be constructed to transmit appreciable torque or friction to the feed screw 31. More specifically, as the hand wheel 33 is rotated in the direction which causes forward advance of the feed screw 31, based on the hand of the thread, the ramped or forward face 37 of the follower 35 will ride up the stationary ramped cam face 37 as shown by FIG. 4, causing an additional component of axial displacement to be superimposed onto the advance of the feed screw 31. The elevator 27 in turn, will receive the forward axial movement of two separate components, the axial advance due to rotation of the nut 32 relative to the feed screw 31 and the axial advance due to the component of the ramped cam face 37 oriented in the axial direction. As the follower 35 approaches the crest 39 of the forward cam face 37, as shown in FIG. 4, the axial displacement of the elevator 27 becomes sufficient to pressurize the product to cause it to flow through the orifices 23.

After the follower 35 has advanced slightly past the crest 39 of the forward face 37, the follower 35 will retract in an axial direction opposite to the direction of forward advance. When the follower 35 retracts, it will come to an intermediate position on the next ramped cam face 37 and ride down this face to the root where it is restrained by the secondary vertical face 38. By moving the follower 35 in a direction which is opposite to the forward travel, the elevator 27 retracts from the product and thereby relieves the residual pressure caused by the forward stroke. It should be obvious that the component of axial displacement the follower 35 moves as it rides up the ramped forward cam face 37 equals the axial distance the follower retracts 35 in the reverse direction to the root of the secondary vertical cam face 38. It should be noted however, that the net forward advance the elevator 27 is greater than the retraction, due to the undirectional forward displacement caused by relative rotation of the feed screw 31 to nut 32. This net advance provides for dispensation of a predetermined quantity of the cream product.

The magnitude of the retraction necessary to reduce the residual pressure such that weeping of the product, or its components, does not take place varies with the thickness and yield pressure of the product and area of the orifices 23 relative to the elevator 27 and chamber 25. As noted above, cams 34 having an axial dimension between 0.25 and 1.40 mm (0.010 to 0.055 inches) work well with a cream product having a Stevens Texture Analyzer Penetration Number from about 150 to about 600 grams and a yield pressure from about 4 to about 20 grams per square centimeter.

A suitable return spring 40 may be inserted in the dispenser to urge the follower in the retraction direction. As shown in FIGS. 3 and 4, a wire-wound helical spring 40 can be inserted into a cylindrical recess in the hand wheel 33. The force exerted by the return spring 40 will vary with the axial position of the follower 35, within a range of approximately 1.3 to 8.9 Newtons (0.3 to 2.0 pounds). The spring 40 is restrained at the bottom by the cylindrical recess in the hand wheel 33 and at the top by a horizontal partition which is integral with the sides 26 of the interior chamber 25 and snapped into position inside the container body 21.

Referring to FIGS. 3 and 4, the interaction of the cam 34 with the return spring 40 will be discussed in more detail. As the ramp angle of the forward face 37 is increased, the elevator 27, feed screw 31 and hand wheel 33 will have a greater tendency to backdrive to the root of the secondary face 38 under the influence of spring 40 which overcomes the system friction, particularly that friction which occurs between the cam 34 and follower 35 and between the elevator 27 and chamber side wall 26. However, a steeper ramp angle increases the drive force necessary to impel the follower in the forward direction. If the drive force becomes too great, the user will perceive difficulty in turning the hand wheel 33. Therefore the ramp angle of the forward cam face 37 and force of the return spring 40 must be balanced to allow the follower 35 to back drive when placed at an intermediate position on the ramped cam face 37 or to retract after passing the crest 39 and yet not require undue difficulty to advance to the crest 39 of the ramp where the force due to spring 40 is greatest.

The number of cams 34, lead angle of the feed screw 31 and cross section of the interior chamber 25 will determine the amount of product dispensed per cycle. It is important that the retraction displacement due to the height of the secondary cam faces 38 be sufficient to reduce residual pressure in the product to a level which does not cause weeping of the product or its components onto the applicating surface 22. Thus, the minimum amount of retraction desired is that which gives sufficient pressure relief, according to the properties of the product being dispensed, to prevent weeping onto the applicating surface 22. However retracting the elevator 27 too far in a given cycle will result in uneven product distribution on the next dispensing cycle. The preferred retraction is within the range of 0.51 to 0.89 mm (0.020 to 0.035 inches).

After the hand wheel 33, feed screw 31 and elevator 27 are retracted under the force of the return spring 40, the motion is suddenly stopped by the next forward cam face 37. The impact of the follower 35 against the stationary cam faces 37 produces an audible and tactile "click" which indicates to the user an incremental dose of the product has been dispensed. This "click" advantageously allows the user to dispense the proper amount of product on a regular basis.

For example, to dispense the desired dose, the user may be instructed, or judge for himself, that the hand wheel 33 should be rotated until three "clicks" are felt and heard. By rotating the hand wheel 33 through an arc sufficient to obtain three "clicks", the user can dispense the desired amount of product with a high degree of precision. Furthermore, by strategically combining the axial advance of the feed screw 31 due to the rotation of the nut 32 with the advance due to riding the cam 34, a minimum dosage can be designed into the dispenser, preventing the user from applying an amount of product which is not sufficient to yield efficacious results. It has been found the predominant tendency of the user is to stop turning the hand wheel 33 shortly after the "click" is sensed. Thus, product is dispensed in discrete incremental doses as the elevator 27 approaches the crest 39 of the ramped cam face 37, rather than in a continuous flow.

Figure 5:
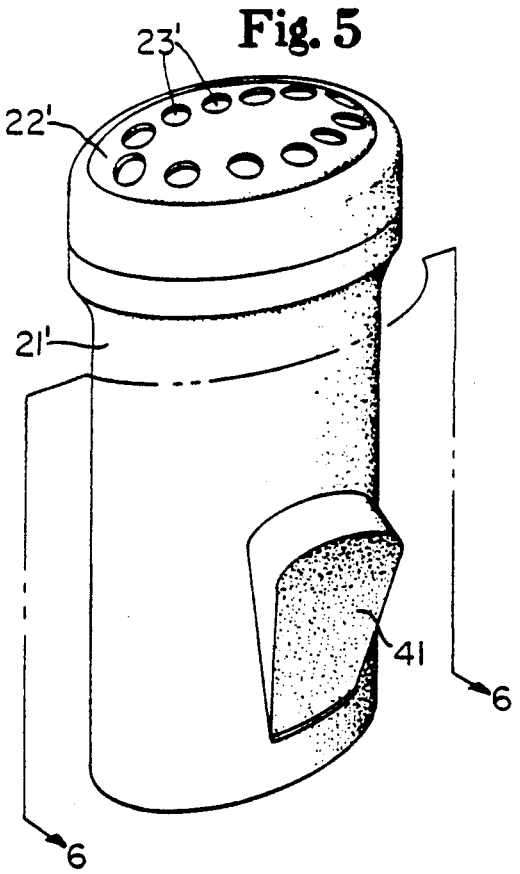
FIG. 5 is a perspective view of a second embodiment of the dispensing package of the present invention employing a push button to effect dispensing.
Figure 6:
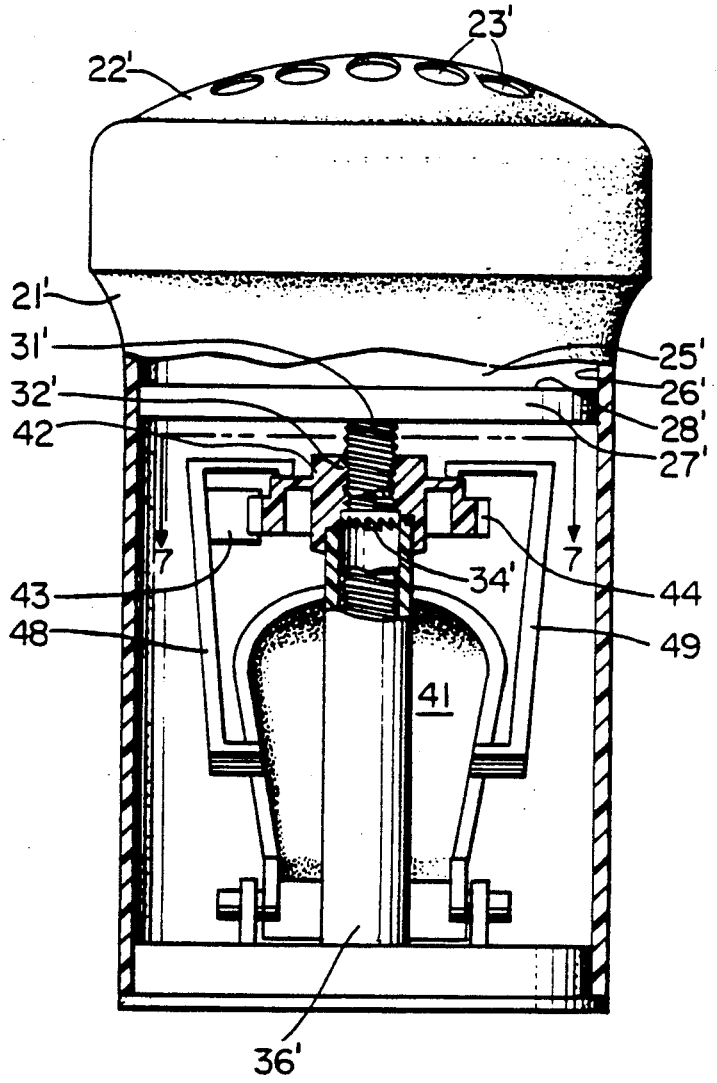
FIG. 6 is a partial vertical sectional view taken along line 6—6 of FIG. 5 showing a cutaway view of the drive mechanism.

A second embodiment having an alternative means to drive the elevator is utilized in the dispensing package illustrated in FIGS. 5 through 9. As shown in FIG. 5, the dispensing package is similar to the embodiment discussed above, with the hand wheel 33 being replaced by a push button 41 which is made of injection molded acetal. Referring to FIG. 6, when manually depressed by the user, the button 41 pivots about the lower fixed end, causing the upper free end to move towards the drive means in a direction transverse the axis of container body 21'. The button 34 has two horizontally oriented integral pegs which fit into coacting stationary mounts, affixed to the base of container body 21'. The upper part of the button 41 then pivots about these pegs when depressed by the user. The base of the container body 21' may be attached to the side walls by a snap lock, annular beading or other conventional means.

Instead of locating the pivot point at the lower end of button 41, the pivot point can be positioned at the side or top of button 41. The button 41 can still be depressed by the user in a direction which is transverse the axis of container body 21', and the pawl 43 can be adapted to engage the wheel 42 in a generally tangential direction. Alternatively, the button 41 can be made to translate perpendicular to the axis of the container body 21, so long as pawl 43 engages the wheel 42 in a generally tangential direction. The button 41 is spring loaded so that it will return to position 45 when released by the user. The maximum spring force should not exceed 22.2 Newtons (5 pounds) when the button is fully depressed. The geometry permits a wire-wound helical spring to be inserted between the button 41 and the vertical post 36'.

Figure 7:
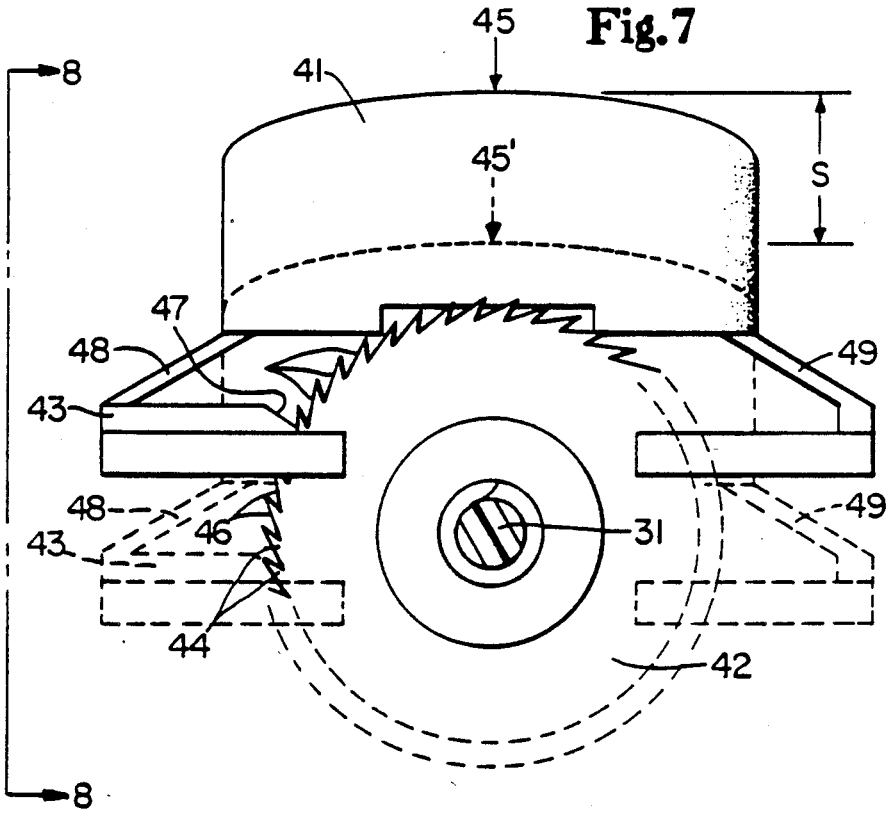
FIG. 7 is a sectional plan view taken along line 7—7 of FIG. 6 showing the button in the outwardly biased position, the depressed button position being shown in phantom.

As the button 41 is depressed and released, an integral pawl 43, illustrated in FIG. 7, moves inwardly and outwardly adjacent the periphery of wheel 42 through an arc or stroke S, as shown in FIG. 6. The wheel 42 is rotatable and perpendicular to the lengthwise axis of the dispensing package and feed screw 31'. A plurality of one way ratchet teeth 44 are rigidly affixed to the circumference of the wheel 42. The wheel is preferentially made of injection molded acetal, although polypropylene has been found to be acceptable and has a diameter of approximately 26 mm (1.0 inch) and 26 ratchet teeth with faces ranging from 1.02 to 1.91 mm (0.040 to 0.075 inches) in the radial direction. When button 41 is pushed inwardly, the pawl 43 engages one of the ratchet teeth 44, imparting a force to the wheel 42 in a generally tangential direction and rotating the wheel an arcuate amount dependent on the size of the wheel 42, the stroke S of the button 41 and radial placement of the pawl 43

Figure 8:
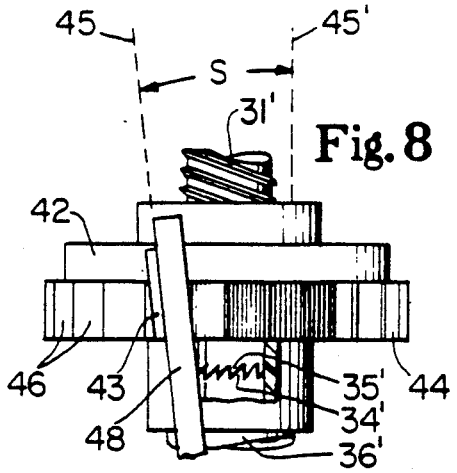
FIG. 8 is a fragmentary vertical view taken along line 8—8 of FIG. 7 showing portions of the drive and reciprocation mechanism of the embodiment of FIG. 5 when the button is in the outwardly biased position and the mechanism retracted.
Figure 9:
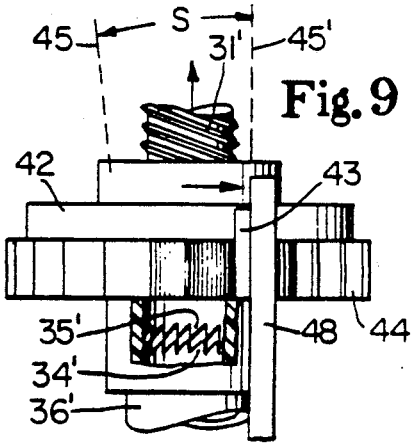
FIG. 9 is a fragmentary vertical view, similar to FIG. 8, when the button is in the depressed position and the mechanism at the forward end of its cycle, immediately prior to retraction.

As shown in FIGS. 8 and 9, the wheel 42 is horizontally mounted on a stationary vertical post 36', which telescopes within an axial counterbore in the hub of wheel 42 and allows the wheel 42 to rotate about its own center. The axial counterbore provides stability for the wheel 42 to float in the axial direction without falling off the vertical post 36'. Vertical post 36' is stationary relative to the container body 21 and in alignment with the lengthwise axis and feed screw 31'. The post may be integrally molded with the polypropylene base, or attached to the sides of the container body 21, such that there is no interference with the drive means. The top of the post 36' may be fitted with sawtooth or V-shaped cams 34' or cams 34' of any other shape judged advantageous and which react against similarly shaped teeth formed in the counterbore and oriented in the nonengaging direction to prevent reverse cycling of wheel 42 when the button 41 is released by the user. Cams 34' constructed according to the description of cams 34, above, are suitable.

As described above, the feed screw 31' and elevator 27' are not rotatable relative to the container body 21' of the dispensing package. Therefore, when the feed screw 31' is threadably inserted through the threaded bore of the hub of wheel 42', rotation of the wheel 42' relative to the feed screw 31' will cause axial movement of the feed screw 31' and elevator 27' in a direction determined by the hand of the lead angle of the screw threads.

Referring to FIGS. 8 and 9, in operation, as the button 41 is depressed by the user, the wheel 42 rotates through an arc subtended by the displacement of the driven ratchet tooth 44 due to the action of the pawl 43 on the tooth. By being rigidly affixed to the nonrotatable elevator 27', the feed screw 31' is held nonrotatable relative to the container body 21'. The relative motion between the internal threads of the wheel 42 and the external threads of the feed screw 31' causes the feed screw 31' to move a predetermined distance in an axial direction. The feed screw 31' is directly linked to the elevator 27', causing it to undergo an identical axial displacement, which action eventually expels the product through the orifices 23' in the applicating surface 22'.

It is necessary that the subsequent driven tooth 44 be positioned close enough to an adjacent prior driven tooth that the pawl 43 will move the second tooth into position after the forward stroke S, from position 45 to position 45', nonengagingly slide past the subsequent tooth on the return stroke S, from position 45' to position 45, then engage this tooth on the next forward stroke, imparting torque to the wheel 42'. Also, the angle of back face 46 of the ratchet teeth 44 and the back face 47 of pawl 43 must allow the pawl 43 to slide over the teeth 44 when the button 41 returns to its starting or outwardly biased position 45. By repeatedly depressing the button 41, and engaging a new driven tooth 44 each time the button 41 is depressed, the wheel 42 can be rotated through a sufficient number of turns to ultimately advance the feed screw 31' and elevator 27' to the wall on which applicating surface 22' is located. The number of teeth 44 and lead angle of the feed screw 31' can be advantageously adapted to provide a desired dose of product for a given cross-sectional interior chamber 25'.

The member 48 holding the pawl 43 is resiliant and advantageously designed to accommodate the preferred motion of the pawl 43. If the member 48 has a rectangular cross section o oriented with the longer side facing the wheel 42 and the shorter side aligned radially with the wheel 42, the member 48 will easily bend in the radial direction. By bending away from the wheel 42, the member 48 more easily accommodates the return stroke S from position 45' to position 45 of the button 41 and pawl 43 past the subsequent ratchet teeth 44. The longer side of the rectangle is designed to ensure sufficient torsional rigidity of the member 48. A member having a cross section with the shorter side ranging from 1.1 to 2.0 mm (0.045 to 0.080 inches) and the longer side of 7.0 mm (0.275 inches) works well. The member is made integral with the button by injection molding both pieces as a single unit, made of acetal.

It is helpful to include a spring which biases the wheel 42 against the stationary post 36' to prevent axial separation of the cams 34' on the stationary post 36' and the coacting follower 35' In the preferred embodiment, the member 48 holding the pawl 43 is fashioned to serve as a tensioned spring clip, shaped like an inverted "L" which bears downward against the wheel 42, preventing separation of the follower 35' from the vertical post 36' on which the follower 35' is mounted. A second spring clip 49, to equally load each side of the wheel 42, is included. The required spring forces ranges from approximately 1.3 to 8.9 Newtons (0.3 to 2.0 pounds), as discussed above.

The faces of the ratchet teeth 44 and pawl 43 can be oriented angularly with respect to the axis of feed screw 31' so that the force imparted to the teeth 44 has a tangential component and a parallel to the axis of the feed screw 31'. The tangential component serves the function of imparting torque to the wheel 42, while the component in the axial direction can be used to reduce the torque required to provide the reciprocation, due to the interaction of the cams 34' and follower 35' by displacing the wheel 42 in the axial direction. This feature becomes more desirable as the height of cams 34' is increased to achieve the necessary pressure relief. By orienting the faces in the opposite direction, the teeth 44 will urge the wheel 42 against the stationary post 36'.

Since the wheel 42 is rotated on an intermittent basis as the button 41 is depressed, the feed screw 31' and elevator 27' will be similarly advanced on an intermittent basis. This causes the product to be dispensed in discrete doses corresponding with the intermittent movements of the elevator 27'. By advantageously adapting the angle of the lead screw 31', the diameter of the circle in which the cams are placed and the stroke of button 41, the dispensing package will accurately and repeatedly dispense a given dose size. Each time the button 41 is depressed the user will sense a "click" which indicates, as described above, that an incremental dose of the product has been dispensed.

Since actual dispensing of product occurs during a relatively small part of the cycle, due to the axial reciprocation noted previously, the user is discouraged from trying to dispense a partial dose. The size of the dose can be adjusted such that the user does not obtain an amount of the product which is too small to yield efficacious results. Furthermore, the dispenser is easily adapted to effective use since the user may be instructed, or judge for himself, that the proper dose is obtained only by depressing the button 41, a certain number of times; for example, three times. The user can therefore quickly and precisely obtain this dose through the simple action of depressing the button 41 the required three times.

Figure 10:
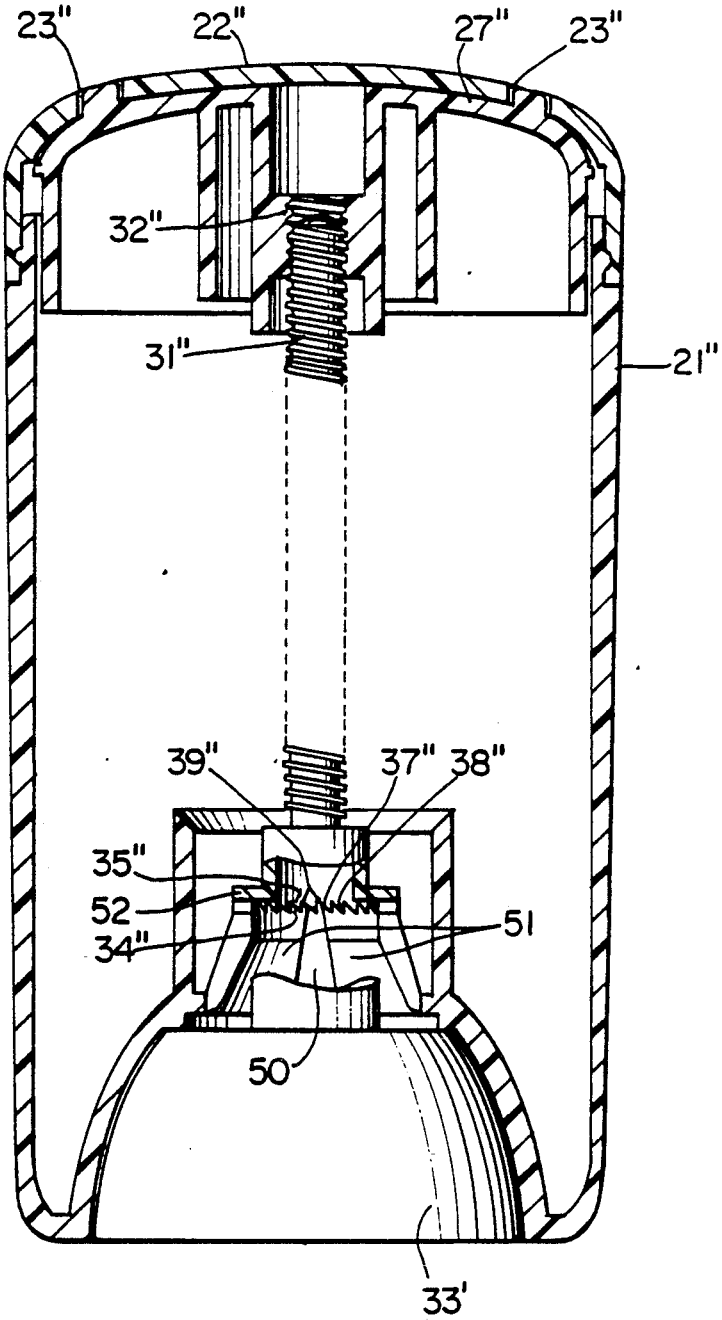
FIG. 10 is a partial vertical sectional view of a third embodiment of the invention having the elevator in the distal position.

A third embodiment, illustrated in FIG. 10 and similar to the embodiment of FIG. 1, utilizes a rotatable hand wheel 33' located at the base of the container body 21''. At the top of the body 21'' is applicating surface 22'' with one or more orifices 23'' as described above. The applicating surface 22'' may be a separate element and retained in position, as shown, by a snap bead or other means known to one skilled in the art. The interior wall of the body 21'' forms the product chamber, which holds the cream product, obviating the need for a separate cavity within the body 21''.

Disposed within the body 21'' is axially movable elevator 27'' congruent to the inside of the body 21''. Rigidly and nonrotatably associated with the bottom of the elevator 27'' is internally threaded nut 32''. The nut 32'' should have an axial length approximately equal to the internal diameter of the nut 32'' to help provide stability to the elevator 27'' during its travel.

The base of the body 21'' is arcuate, having a recess which is convex towards the applicating surface 22''. The base recess is disposed above the hand wheel 33' and has a centrally located axially tapered hole 50 therein. The lowest elevation of hole 50 is at the base recess. The hole 50 is centered between a plurality of cantilevered fingers 51, typically four. Each finger 51 has one end affixed to the container body 21'' base and extends upwardly towards the applicating surface 22'' and radially inwardly towards the central axis, terminating in a free end. The free ends of the fingers 51 are disposed at an elevation above the base and define the circumference of the top of hole 50, which circumference is smaller than that of hole 50 at the elevation of the base. The free ends of fingers 51 also define the highest axial position of hole 50. Each finger 51 is separated from the adjacent fingers 51 by slots, allowing each finger 51 to deflect independently of the other fingers 51.

Fingers 51 having fixed ends disposed about the circumference of base hole 50 and which form an angle of about 70° relative to the horizontal are suitable. It will be apparent to one skilled in the art that the fingers 51 could also be cantilevered from other positions on the base or from the inside wall of the container body 21'', so long as the fingers 51 do not interfere with the movement of elevator 27''. It will be further apparent that the fingers 51 could be oriented at other angles, including parallel to the horizontal.

Disposed on the free end of each finger 51, is a plurality of cams 34''. The cams 34'', as described above, may be shaped like saw tooth ratchet teeth, as shown, may be V-shaped, or any other profile judged to be advantageous by the user may be employed. For the embodiment shown herein, cams 34'' having a forward face 37'' ramped from about 20° to about 50°, preferably about 40° relative to the horizontal and an abrupt secondary face 38'' having an axial dimension ranging from about 0.25 mm to about 1.40 mm (0.010 to 0.055 inches) are generally suitable. The free end of finger 51 will accommodate five to seven cams 34'' thereon. If desired, a space or land (not shown) may be interposed between adjacent cams 34'' to provide for a desired number of cams 34'' on a finger 51 at a specified diameter and having a specified forward face 37'' ramp angle.

A polypropylene body 21'' having an integral base with a hole 50 of approximately 17.0 mm (0.657 inches) diameter and four fingers 51 extending approximately 7.8 mm (0.310 inches) in the axial direction, with free ends disposed on a diameter of approximately 11.9 mm (0.470 inches), a circumferential dimension, or width, of approximately 6.4 mm (0.250 inches) and a radial dimension of not less than 1.9 mm (0.075 inches) has been found to work well. It is important that the radial dimension be large enough to provide sufficient contact area on the cam face to prevent excessive contact stress levels from occurring.

Figure 11:
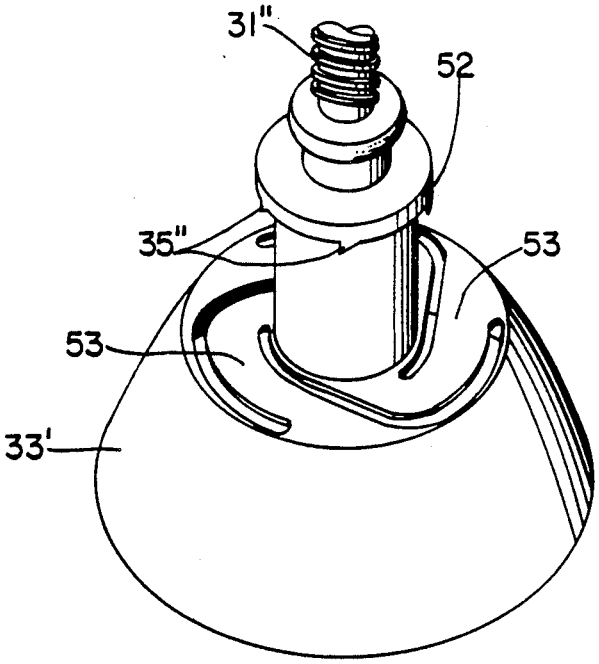
FIG. 11 is a fragmentary perspective view of the hand wheel and feed screw assembly of FIG. 10.

Referring to FIG. 11, an axially rotatable hand wheel 33' is disposed beneath the arcuate base of the body 21'' in the recess of the base. The hand wheel 33' should have a exterior profile generally conforming to the recess of the base and extending outwardly from the sides of the body 21' so that the hand wheel 33' may be easily grasped by the user.

Nonrotatably associated with the hand wheel 33', preferably integral, is coaxial feed screw 31''. Disposed about the periphery of the feed screw 31'' is a plurality of ratchet teeth, or followers 35'', adapted to coact with the cams 34'' disposed on the free ends of the fingers 51 and preferably equal in number to the number cams 34'' on the fingers 51. However, as shown, a minimum of about four teeth 35'' are necessary to provide stability for the mechanism and prevent erratic movement of the elevator 27''. The ratchet teeth, or followers 35'', of the feed screw 31'' may depend from a circumferential collar 52, as shown, or otherwise protrude laterally from the circumference of the feed screw 31''.

Either the cams 34'' or followers 35'' should not be equally spaced about the central axis, such that any point in time, not all of the followers 35'' are in an azmuthal position corresponding to the slots between the fingers 51. This can be accomplished by having each of the four fingers 51 subtend an arc not equal to 90°. The slots are no wider than three-fourths of a tooth 37'', to provide stability to the followers 35'' Preferentially, at least four followers 35'', spaced approximately 90° apart, are engaged with the cams 34'' at all times.

The hand wheel 33' and feed screw 31'' assembly has a return spring 53 associated therewith. The return spring 53 is preferentially incorporated into the hand wheel 33', as shown, to prevent accidental dispensing of product should the hand wheel 33' be bumped, as for example, during packing of the dispensing containers. One manner in which the return spring 53 can be incorporated into the hand wheel 33' is to provide a plurality of spokes extending from the central portion of the hand wheel 33' to the periphery of the hand wheel 33' and radiating in a spiral pattern as shown. The spokes flex, allowing relative axial displacement between feed screw 31'' and hand wheel 33'. The spiral pattern of the spokes should be such that the spokes are tensioned as the hand wheel 33' is rotated. Alternatively, it will be apparent to one skilled in the art, that the return spring 53 may be external the hand wheel 33', such as a leaf spring (not shown) cantilevered from the interior of the container body 21''

For the embodiment described herein, an acetal hand wheel 33' having a diameter at the lowermost portion of approximately 37.3 mm (1.47 inches) and a thickness of approximately 1.4 to 1.5 mm (0.055 to 0.060 inches) is suitable. The plurality of followers 35'' may be disposed approximately 9.0 mm (0.355 inches) above the L top of the hand wheel 33'. Approximately 14.3 mm (0.562 inches) above the top of the hand wheel 33' is a suitable elevation for the axial position of the collar 52. A collar 52 having a diameter of about 7.5 mm (0.297 inches) is sufficiently narrow to push through the hole 50 between the free ends of the fingers 51. The proximal end of the feed screw 31'' is preferentially disposed immediately above the collar 52. A spring 53 having a rate of approximately 3600 gm/cm (20 pounds per inch) is suitable. Such a spring rate can be approximated by a triskelion shaped spring 53 having spokes approximately 0.8.to 0.9 mm (0.030 to 0.035 inches) in thickness, approximately 4.6 mm wide (0.180 inches) and separated by slots approximately 1.0 mm (0.040 inches) wide.

One suitable drive means has an elevator 27'' of approximately 11 square centimeters (1.7 square inches) and a feed screw 31'' of approximately 5.6 mm (0.220 inches) diameter. The feed screw 31'' is centered between approximately 28 cams 34'' on a diameter of about 13.8 mm (0.540 inches). The cams 34'' have a forward face 37'' inclined at approximately 40 relative to the horizontal and an axial dimension of about 0.51 mm (0.020 inches). A feed screw 31'' which axially advances about 1.3 mm (0.05 inches) per rotation will dispense approximately 0.045 cubic centimeters of the cream product described above each time a cam 34 is traced. If the feed screw 31'' is made to advance about 5.1 mm (0.20 inches) per rotation, approximately 18 cubic centimeters of the product is dispensed each time a cam 34'' is traced.

The package is assembled by inserting the elevator 27'' in the top of the product chamber and pushing the elevator 27'' downwardly until the nut 32'' protrudes through the hole 50 in the base. The feed screw 31'' is then threadably engaged with the nut 32'', and the hand wheel 33', feed screw 31'' and elevator 27'' are pushed upwardly towards the top of the container body 21'', until the collar 52 snaps into place above the plurality of fingers 51. The fingers 51 will spring outwardly until admitting the collar 52, but will be compressed and engage the collar 52 should one attempt to retract or pull the hand wheel 33' back out of the bottom of the dispensing package. The feedscrew 31'' is rotated via hand wheel 33', drawing the elevator 27'' assembly to its proximal, or lowermost, position.

Figure 13:
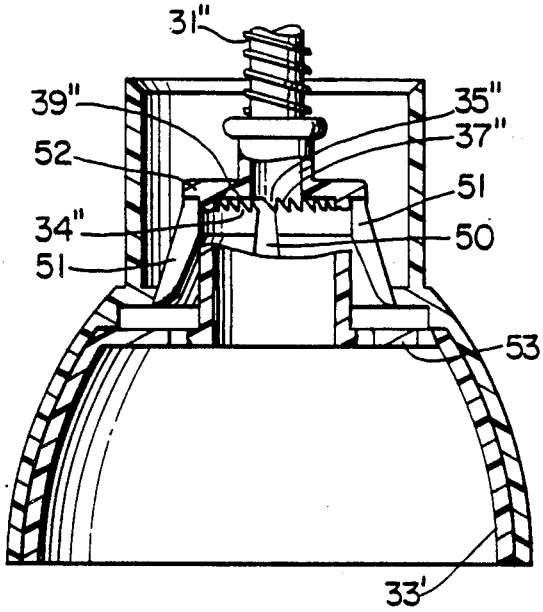
FIG. 13 is a partial fragmentary vertical view, similar to that of FIG. 12, with the mechanism retracted.
Figure 12:
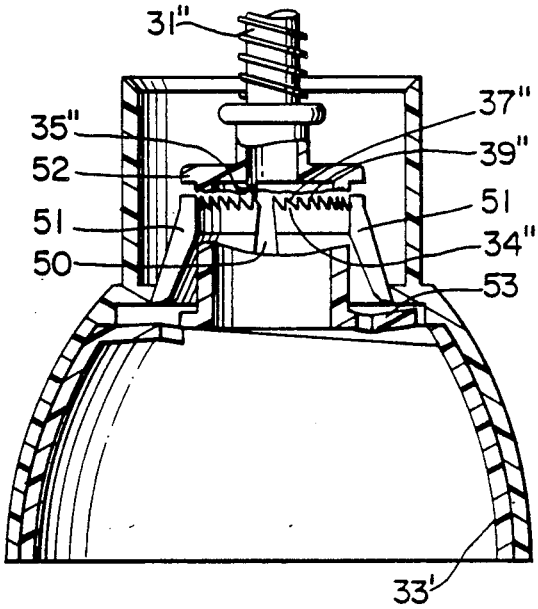
FIG. 12 is a partial fragmentary vertical view of the drive and reciprocation mechanism of the embodiment of FIG. 10 with the mechanism at the forward end of the cycle, immediately prior to retraction.

In operation and similar to the first embodiment, as the user rotates the hand wheel 33', the followers 35'' ride up the ramped forward cam faces 37'', causing an axial displacement of the feed screw 31'' and hence elevator 27'' assembly, as shown in FIG. 12. After reaching the crest 39'' of the cams 34'', the feed screw 31'' and elevator 27'' retract to the proximal position shown in FIG. 13. Similar to the foregoing embodiments, as the feed screw 31'' is turned relative to the nut 32'' which is associated with the elevator 27'', a separate axial advance is caused thereby. The superposition of the displacements resulting from the interaction of the cams 34'' and followers 35'' and advance of the elevator 27'' due to relative rotation with the feedscrew, causes the elevator 27'' to advance enough to extrude product through the orifices 23'', then retract to relieve residual pressure on the product.

As the user turns the hand wheel 33', it is restrained from axial movement by bearing against the base of the body 21'', However, as the feed screw 31'' rides up on the forward cam faces 37'' the spokes of spring 53 are axially tensioned and provide the return force necessary to cause retraction of the feed screw 31'' and elevator 27'' assembly. After the feed screw 31'' assembly reaches the crest 39'' of the cam 34'' faces, the tension in the spokes of the return spring 53 retracts the feed screw 31'' and elevator 27'' assembly to the proximal position of FIG. 13.

The embodiments of the invention described in FIGS. 1–4, 5–9, and 10–13 are equipped to provide both discrete dosing and pressure relief of the cream product. Either characteristic can be amplified or reduced, as necessary to accommodate a specific combination of dispensing package and cream product. How these characteristics are related, and can be tuned, to provide the desired operation of the dispensing package, is best illustrated by referring to the graphical illustrations shown in FIGS. 14 through 16, which apply equally well to the drive means of each embodiment discussed above.

For a product of a given yield pressure, the graphs illustrate that when less force is applied to expel the product through orifices 23, less residual pressure will remain on the product. The amount of force applied to expel the product is related to the axial advance caused by rotation of the feedscrew and the cross-sectional area, and to a lesser extent distribution, of orifices 23. As the yield pressure remaining within the product after dispensation increases, the amount of axial retraction caused by cams 34 must be proportionally increased. This will prevent the product or its components from weeping onto the applicating surface 22. Furthermore, the container body 21 is not perfectly rigid and may be placed in tension by high residual yield pressures.

Figure 14:
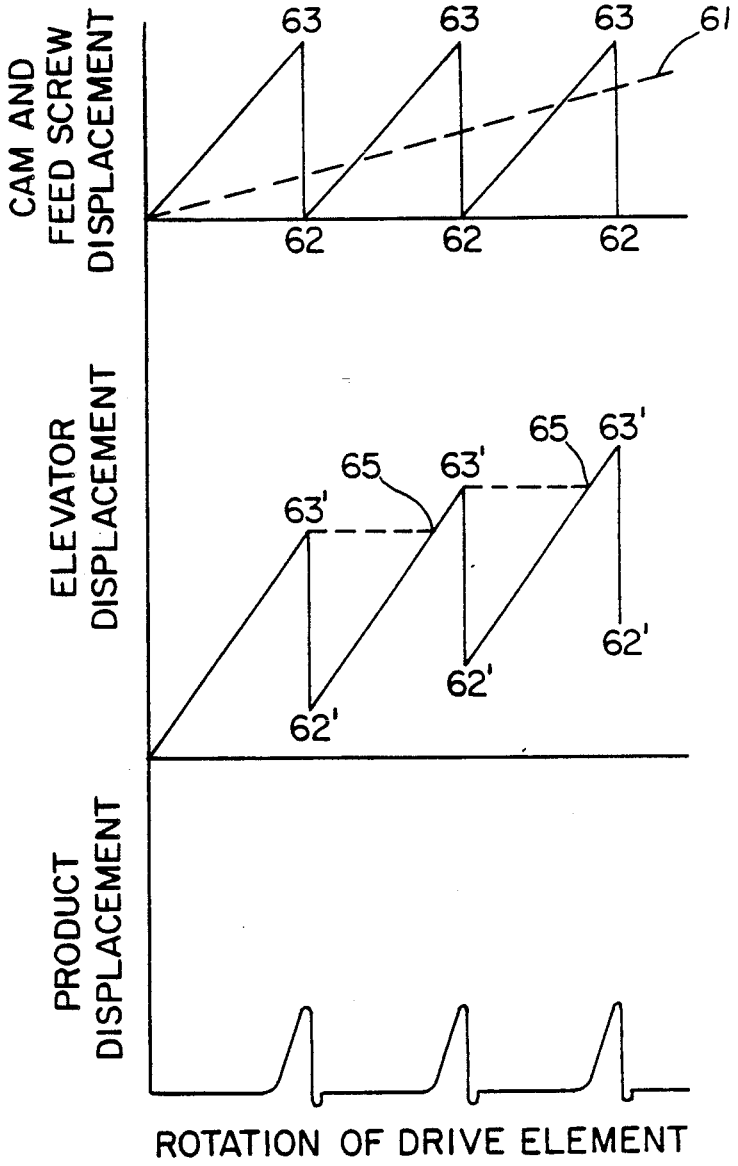
FIG. 14 is a graphical representation of the operation of a dispenser having both pressure relief and discrete dosing characteristics.

The elevator displacement is graphically illustrated by FIG. 14, which shows the relationships between elevator displacement and product dispensed on the vertical axis and hand wheel 33 or ratchet wheel 42 rotation on the horizontal axis. A line 61 drawn from the first origin represents the elevator 27 displacement due to advance of the feed screw 31 caused by rotation relative to nut 32, without riding on the cams 34. Lines 62-63-62 of the same graph represent the axial advance of elevator 27 due to the follower 35 tracing the profile of the saw tooth shaped cams 34.

Since the displacement component of lines 62–63 is oriented in the same sense as the advance of the feed screw 31 caused by rotation of the hand wheel 33 or ratchet wheel 42 relative to nut 32, the displacement will be constructively superimposed, causing the follower 35 to undergo greater forward advance than if acted upon by either displacement alone. The displacements along lines 63–62 represents the retraction of the elevator 27 and follower 35, which is equal to and detracted from the forward axial displacement components, causing the follower 35 to stop in an axial position governed by the advance of feed screw 31.

The two curves shown on the first horizontal axis of FIG. 14, can be superimposed, as shown by the resultant curve on the second horizontal axis, to give the axial displacement of the elevator 27. This superposition is shown by points 62 and 63 of the first graph shifting to points 62' and 63' in the second graph. The displacement of the follower 35 as it rides on cams 34 is superimposed with the axial displacement of the feed screw 31 to give the resultant cycle shown by lines 62'-63'-62'. If the feed screw displacement line 61 is superimposed on the resultant cycle 62'-63'-62', line 61 will intersect at points 62'.

The retraction of the elevator 27 occurs along the vertical line 63'-62' in FIG. 14 after the product has been dispensed. When the elevator 27 retracts, pressure on the product is relieved. This results in a deadband, shown as line segment 63'-65 in FIG. 14. The deadband 63'-65 is the portion of the cycle in which no dispensing of product occurs during the initial phase of forward axial movement. As shown on the third horizontal axis of FIG. 14, product is not dispensed until the elevator 27 is near point 65, the furthest axial position attained during the preceding cycle.

This phenomenon allows one skilled in the art to enhance the discrete incremental dosing of a dispensing package which accomplishes pressure relief. By having the deadband 63'-65 control a large percentage of the dispensing cycle and dispensation occur during only a small part of the cycle, as shown by the third axis of FIG. 14, the user is discouraged from trying to extrude a partial dose by rotating the hand wheel 33 or depressing the button 41 to an intermediate position between the cams 34. The amount of deadband 63'-65 in the cycle can be increased by reducing the lead angle of the feed screw 31.

By reducing the height of the secondary cam faces 38 to a point below which the amount of retraction does not relieve enough residual pressure to prevent weeping of the cream product onto the applicating surface, the pressure relief characteristic of the dispensing package can be reduced. However, if the lead angle of the feed screw 31 is adjusted, as described above, to provide a small advance of the elevator 27, relative to the advance due to the cams 34, the dosing feature described above is maintained.

This dosing effect is characterized by dispensing product only during a short part of each cycle. Typically, when approximately one quarter or less of the rotation between "clicks" dispenses product, and the remaining rotation advances the elevator 27 a distance which is insufficient to dispense product, the dosing effect defined by this invention is maintained. Dispensing, at a non-uniform rate, which gives discrete dosing can be maintained with a deadband 63'-65 of less than one-half the dispensing cycle, but a deadband of three-fourths cycle or greater is preferred.

Figure 15:
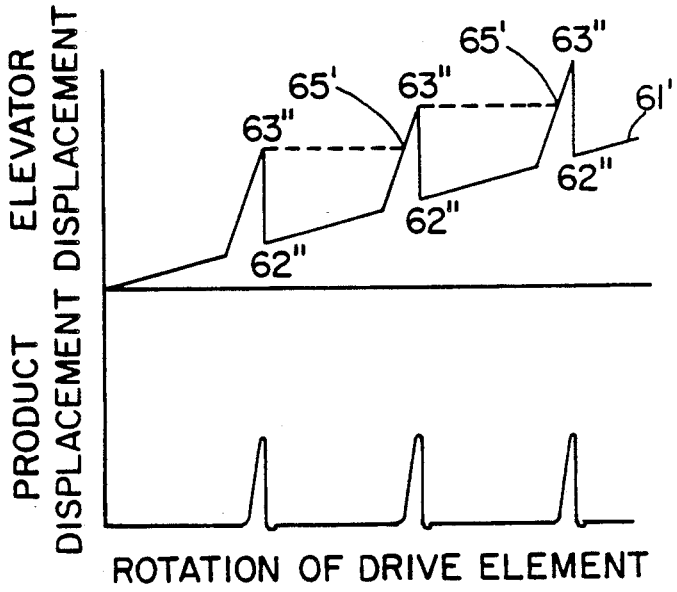
FIG. 15 is a graphical representation of the operation of a dispenser having exaggerated discrete dosing characteristics.
Figure 16:
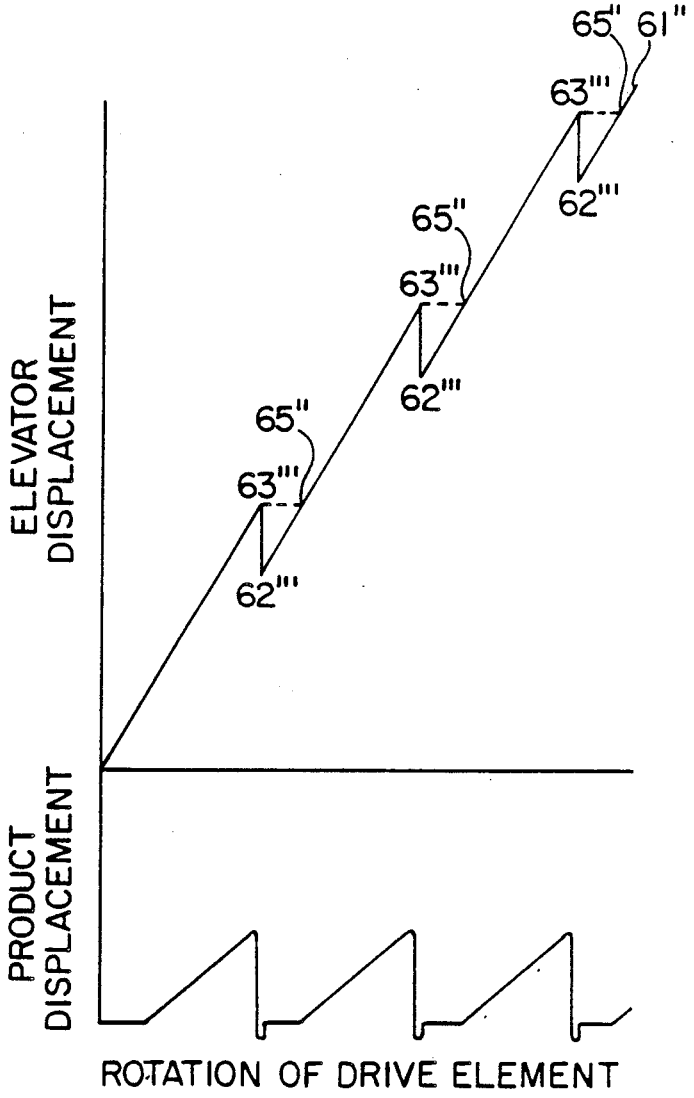
FIG. 16 is a graphical representation of the operation of a dispenser having pressure relief characteristics but not discrete dosing characteristics.

This dosing effect can be amplified, as graphically illustrated in FIG. 15, by adding spaces or lands between the cams 34 which cause the follower 35 to dwell in the axial direction. There is negligible, if any, product dispensed in the large part of the cycle 62''–65' that is characterized only by the advance of the feed screw 31 and by riding up the cam to the maximum forward displacement of the previous cycle. As shown on the second horizontal axis of FIG. 15, the dispensation of the product will be effectively limited to that portion of the cycle 65'-63'', which includes both the axial advance of the cam 34 and feed screw 31 beyond the furthest axial position of the previous cycle.

In a contrary fashion, the invention can be adapted to a dispensing package which emphasizes pressure relief but not the dosing effect. If the lead angle of the feed screw 31 is increased, and the height of cams 34 retracts the elevator 27 a distance which is sufficient to relieve the residual pressure to a degree which prevents weeping onto surface 22, as graphically illustrated by the increased slope of line 61'' of FIG. 16, the invention increases the pressure relief without increasing the dosing effect. The height of the cams 34 will provide enough pressure relief to prevent weeping and the increased lead angle of the thread of the feed screw 31, will cause an exaggerated part of the cycle 65''-63''' to dispense product, as shown on the second horizontal axis of FIG. 16. Thus, by selectively incorporating the proper cam height, feed screw lead angle, interior chamber cross section and properties of the cream product, the dispenser can be designed to amplify either the dosing characteristic, pressure relief characteristic, or both.

It will be apparent to one skilled in the art that a variety of alternative drive means are known to advance a feed screw. For example, in the first and third embodiments, the proximal end of feed screw 31 could be fitted with gear teeth. These gear teeth could then be engaged with the teeth of a mating gear which extends outside of the container body to be rotated by the user and in turn drive the feed screw 31. Such a device is closely related to the first and third embodiments as described above, differing only in that the rotatable hand wheel 33 is a gear which drives feed screw 31.

Referring to the second embodiment, illustrated by FIGS. 5 through 9, the means to convert transverse movement of the button 41 into relative rotary movement between the feed screw 31' and nut 32' could be arranged to suit the elevator drive arrangement. For example, in a variant of the drive means discussed above the nut 32' is nonrotatably affixed to the elevator 27 and an axially affixed feed screw 31' is made rotatable, the feed screw 31' could be made integral with the ratchet wheel 42 so that one portion of the feed screw 31' has ratchet teeth 44 and a second portion of the feed screw 31' has exterior threads. If the pawl 43 directly (7- imparts the force to the ratchet teeth 44 portion of a rotatable feed screw 31' which is threaded through a nonrotatable nut 32', and affixed to elevator 27', the feed screw 31' will rotate relative to nut 32' and thereby provide axial advance as described above. If such a feed screw 31' is rotatable and affixed to the elevator 27', the part with the ratchet teeth 44 will have an axial length equivalent to the total travel of the elevator 27.

A variety of related drive means are known to advance the elevator 27 of any swivel-up dispensing package described above. These rely on relative motion between a feed screw 31 and a nut 32 in the package. Either can be rotated to provide the movement of the elevator 27, depending on the arrangement. A family of mechanisms could be constructed having a non-rotating nut 32 and rotating feed screw 31. For example, the nut 32 can be attached to the elevator 27 and an axially affixed feed screw 31 rotated, or the nut 32 could be mounted in fixed relationship with the package body 21 and a feed screw 31, rotatably affixed to the elevator 27, turned to effect dispensing. Alternatively, a family of other mechanisms can be constructed having a rotating nut 32 and a non-rotating feed screw 31. So long as this relative rotation between the nut 32 and feed screw 31 is maintained, either family of mechanisms would be a feasible drive means for the dispensing package.

There is also a variety of closely related and feasible alternative embodiments for the cam 34 and follower 35 system. The embodiments illustrated by the figures show a plurality of stationary cams 34 and followers 35 which are associated with the elevator 27 through a rotating hand wheel 33 or ratchet wheel 42. The illustrated followers 35 are specifically adapted to the saw tooth shaped profile of cams 34. Obviously, a generic follower having one or more axial tines, equally suited to tracing a variety of cam 34 profiles could be utilized. The designer may additionally wish to interchange the positions of the cam 34 and follower 35, such that the follower 35 is stationary, and the cam 34 is associated with the rotating component and elevator. This is easily accomplished since the elevator 27 and follower 35 can be associated with and driven either by riding on the axial motion of a follower 35 or a cam 34. Many other changes can be made without departure from the spirit and scope of the present invention.

We claim:

1. A dispensing package for cream products, said dispensing package comprising:

(a) a container body having an interior chamber of generally uniform cross section to contain said product and a lengthwise-extending central axis;

(b) an elevator having a cross section congruent to and mounted for axial movement within said chamber;

(c) means for axially reciprocating said elevator; and (d) means being axially rotatable for axially advancing said elevator; said axial rotation resulting in said axial advancement, said means for axially reciprocating said elevator and said means for axially advancing said elevator cooperating to reciprocate the elevator one cycle for each predetermined increment of forward axial advancement of the elevator by the means for axially advancing said elevator.

2. A dispensing package according to claim 1, wherein the axially rotatable means for advancing the elevator comprises an axially extending feed screw and a nut aligned with and threadably engaged with said feed screw, one of said feed screw and said nut being nonrotatable relative to the container body and being associated with the elevator, and the other being rotatable and having a hand wheel associated therewith, the arrangement being such that relative rotary movement between the two causes axial movement.

3. A dispensing package according to claim 1 wherein the means to advance the elevator comprises an axially extending feed screw, said feed screw being threadably connected with a wheel having a plurality of ratchet teeth disposed about its periphery said wheel being rotated about the axis of the feed screw by an external means for imparting force to a ratchet tooth of said wheel in a generally tangential direction.

4. A dispensing package according to claim 1, wherein the means to advance the elevator comprises an axially extending rotatable feed screw, having a plurality of ratchet teeth associated with one portion of its length and an exterior thread associated with a second portion of its length, said feed screw being rotated about its axis by an external means for imparting force to a ratchet tooth of said feed screw in a generally tangential direction.

5. A dispensing package according to claim 1, wherein the means to advance the elevator comprises an axially extending feed screw affixed to the underside of said elevator, said feed screw being moved axially by engagement with a rotatable gear.

6. A dispensing package according to claim 1 wherein the means for axially reciprocating the elevator comprises a cam and a follower, one of said cam and said follower being axially rotatable, the other of said cam and said follower being non-rotatable, said cam and follower being biased towards one another and adapted to provide axial reciprocating movement to the elevator, reflecting successive rises and falls when one is rotated with respect to the other.

7. A dispensing package according to claim 6 wherein the cams is associated with the elevator and the follower is associated with a rotating component.

8. A dispensing package according to claim 6 wherein the cams is associated with the elevator and the rotating component.

9. A dispensing package according to claim 6 wherein the follower is associated with the elevator and the rotating component.

10. A dispensing package according to claim 6 comprising a plurality of cams disposed in a circular fashion about an axially extending stationary post, said plurality of cams imparting a like number of reciprocal axial movements to said elevator for each revolution of a rotating element.

11. A dispensing package according to claim 10 wherein the plurality of cams have a generally saw tooth shaped profile and the follower has a generally saw tooth shaped profile adapted to engage with said cams.

12. A dispensing package according to claim 10 wherein the plurality of cams have a generally V-shaped profile and the follower has a generally V-shaped profile adapted to engage with said cams.

13. A dispensing package according to claim 6 comprising a plurality of cams disposed in a circular fashion about the base of the container body, said plurality of cams imparting a like number of reciprocal axial movements to said elevator for each revolution of a rotating element.

14. A dispensing package according to claim 1 wherein the means to cause axial reciprocation results in a uniform retraction of the elevator for each predetermined increment of forward axial movement.

15. A dispensing package according to claim 1 wherein the axially rotatable means for advancing the elevator is caused by the relative rotation between a nut and feed screw and is superimposed with axial reciprocation caused by a cam and a follower biased towards one another.

16. A dispensing package according to claim 1 wherein the means for axially reciprocating the elevator comprises a cam having an axial dimension of about 0.25 to about 1.40 mm and a follower adapted to ride on said cam, the follower and the cam being biased towards one another.

17. A dispensing package according to claim 1 wherein the means for axially reciprocating the elevator comprises a cam having an axial dimension of about 0.51 to about 0.89 mm and a follower adapted to ride on said cam, the follower and the cam being biased toward one another.

18. A dispensing package according to claim 1 further comprising a spring means to urge retraction of the elevator.

19. A dispensing package according to claim 1 wherein the means to advance the elevator comprises a feed screw and a nut coaxial of said central axis and threadably engaged, one of said feed screw and said nut being non-rotatable and associated with said elevator, the other being rotatable.

20. A dispensing package according to claim 19 further comprising a base at the bottom of said container body and having a hole therein; a plurality of cantilevered fingers affixed to one of said base and said container body and radially extending towards said central axis, said fingers terminating in a free end having a plurality of one of cams and followers thereon; a plurality of one of cams and followers which are complementary to the one of cams and followers on said fingers being associated with the one of said feed screw and said nut which is rotatable; an axially rotatable hand wheel disposed below said base and non-rotatably affixed to the said one of said feed screw and said nut which is rotatable, said feed screw extending through said hole in said base whereby rotation of said feed screw or said nut provides axial reciprocating movement to the elevator, reflecting successive rises and falls of the cams and followers relative to one another.

21. A dispensing package according to claim 20 further comprising a circumferential shoulder affixed to said feed screw and adapted to prevent said feed screw from being retracted through said hole in said base.

22. A dispensing package according to claim 20 further comprising a spring integral with said hand wheel.

23. A dispensing package according to claim 20 having four fingers.

24. A dispensing package according to claim 23 wherein one of said cams and said followers are not equally spaced about said axis.

25. A dispensing package according to claim 1 wherein said axially rotatable means is adapted to provide a tactile indication to the user each time said elevator is axially reciprocated.

26. A dispensing package according to claim 1 wherein said axially rotatable means is adapted to provide an audible indication to the user each time said elevator is axially reciprocated.

27. A dispensing package according to claim 25 wherein said axially rotatable means is further adapted to provide an audible indication to the user each time said elevator is axially reciprocated.

* * * * *

UNITED STATES PATENT AND TRADEMARK OFFICE

CERTIFICATE OF CORRECTION

PATENT NO. : 5,000,356

DATED : March 19, 1991

INVENTOR(S) : R. C. Johnson, C. S. Cook, D. R. Long

It is certified that error appears in the above-identified patent and that said Letters Patent is hereby corrected as shown below:

Column 1, line 47, after "the" delete -- o -- .

Column 4, line 12, after "also" delete -- o -- .

Column 10, line 67, after "section" delete -- o -- .

Column 11, line 29, after "a" insert -- component -- .

Column 13, line 33, after "35" insert -- . -- .

Column 13, line 60, after "the" delete -- L -- .

Column 14, line 14, "40" should read -- 40° -- .

Column 17, line 23, after "directly" delete -- (7- -- .

Column 18, line 64, "cams" should read -- cam -- .

Column 18, line 67, "cams" should read -- cam -- .

Column 19, line 33, after "for" insert -- axially -- .

Signed and Sealed this

Twenty-third Day of March, 1993

*Attest:*

STEPHEN G. KUNIN

*Attesting Officer*

*Acting Commissioner of Patents and Trademarks*